US007845761B2

(12) United States Patent
Nagata

(10) Patent No.: US 7,845,761 B2
(45) Date of Patent: Dec. 7, 2010

(54) INK JET PRINTING APPARATUS AND CONTROL METHOD FOR REDUCING PRELIMINARY EJECTION

(75) Inventor: Shingo Nagata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 12/270,444

(22) Filed: Nov. 13, 2008

(65) Prior Publication Data

US 2009/0128592 A1 May 21, 2009

(30) Foreign Application Priority Data

Nov. 20, 2007 (JP) ..... 2007-300827

(51) Int. Cl.
*B41J 2/165* (2006.01)
*B41J 29/38* (2006.01)
*B41J 2/145* (2006.01)

(52) U.S. Cl. ..... 347/35; 347/12; 347/40

(58) Field of Classification Search ..... 347/12, 347/35

See application file for complete search history.

(56) References Cited

U.S. PATENT DOCUMENTS 5,289,207 A * 2/1994 Ebisawa ..... 347/35
5,701,146 A * 12/1997 Akiyama et al. ..... 347/35
2007/0057984 A1* 3/2007 Takamiya et al. ..... 347/10
2008/0239007 A1* 10/2008 Tomizawa et al. ..... 347/56

FOREIGN PATENT DOCUMENTS

JP 6-246931 9/1994
JP 2004-90292 3/2004

OTHER PUBLICATIONS

U.S. Appl. No. 12/273,138, filed Nov. 18, 2008.
U.S. Appl. No. 12/364,795, filed Feb. 3, 2009.

* cited by examiner

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

In an ink jet printing apparatus, preliminary ejection for a print head involving a plurality of distances from a common ink supply port to respective ejection openings is optimized. Specifically, for a first nozzle array and a second nozzle array with different distances from the ink supply port to the ejection opening, the ratio of a driving pulse width to a lower limit pulse width for the second nozzle array with the longer distance is set to be higher than the ratio for the first nozzle array with the shorter distance. This enables a reduction in the time required for preliminary ejection of the apparatus as a whole.

6 Claims, 11 Drawing Sheets

| DISTANCE FROM INK SUPPLY PORT TO EJECTION OPENING | P1 | P1/Pth1 | NUMBER OF INK DROPLETS EJECTED IN PRELIMINARILY EJECTION / ONE EJECTION OPENING | INPUT ENERGY / ONE EJECTION OPENING |
|---|---|---|---|---|
| 75μm | 0.508μsec | 1.08 | 23000 | 8693μJ |
| | 0.698μsec | 1.49 | 11000 | 5712μJ |
| | 0.994μsec | 2.12 | 9000 | 6656μJ |
| DISTANCE FROM INK SUPPLY PORT TO EJECTION OPENING | P2 | P2/Pth2 | NUMBER OF INK DROPLETS EJECTED IN PRELIMINARILY EJECTION / ONE EJECTION OPENING | INPUT ENERGY / ONE EJECTION OPENING |
| 123μm | 0.508μsec | 1.08 | EQUAL TO OR GREATER THAN 100000 | EQUAL TO OR GREATER THAN 37795μJ |
| | 0.698μsec | 1.49 | 33000 | 17137μJ |
| | 0.994μsec | 2.12 | 12000 | 8874μJ |

| DISTANCE FROM INK SUPPLY PORT TO EJECTION OPENING | P1 | P1/Pth1 | NUMBER OF INK DROPLETS EJECTED IN PRELIMINARILY EJECTION / ONE EJECTION OPENING | TIME REQUIRED FOR PRELIMINARY EJECTION |
|---|---|---|---|---|
| 75μm | 0.508μsec | 1.08 | 23000 | 3.35sec |
| | 0.698μsec | 1.49 | 11000 | 1.60sec |
| | 0.994μsec | 2.12 | 9000 | 1.31sec |
| DISTANCE FROM INK SUPPLY PORT TO EJECTION OPENING | P2 | P2/Pth2 | NUMBER OF INK DROPLETS EJECTED IN PRELIMINARILY EJECTION / ONE EJECTION OPENING | TIME REQUIRED FOR PRELIMINARY EJECTION |
| 123μm | 0.508μsec | 1.08 | EQUAL TO OR GREATER THAN 100000 | EQUAL TO OR GREATER THAN 14.58sec |
| | 0.698μsec | 1.49 | 33000 | 4.81sec |
| | 0.994μsec | 2.12 | 12000 | 1.75sec |

FIG.6

| DISTANCE FROM INK SUPPLY PORT TO EJECTION OPENING | P1 | P1/Pth1 | NUMBER OF INK DROPLETS EJECTED IN PRELIMINARILY EJECTION / ONE EJECTION OPENING | INPUT ENERGY / ONE EJECTION OPENING |
|---|---|---|---|---|
| 75μm | 0.508μsec | 1.08 | 23000 | 8693μJ |
| | 0.698μsec | 1.49 | 11000 | 5712μJ |
| | 0.994μsec | 2.12 | 9000 | 6656μJ |
| DISTANCE FROM INK SUPPLY PORT TO EJECTION OPENING | P2 | P2/Pth2 | NUMBER OF INK DROPLETS EJECTED IN PRELIMINARILY EJECTION / ONE EJECTION OPENING | INPUT ENERGY / ONE EJECTION OPENING |
| 123μm | 0.508μsec | 1.08 | EQUAL TO OR GREATER THAN 100000 | EQUAL TO OR GREATER THAN 37795μJ |
| | 0.698μsec | 1.49 | 33000 | 17137μJ |
| | 0.994μsec | 2.12 | 12000 | 8874μJ |

FIG.7

FIG.10

| SIZE OF INK DROPLET | DISTANCE FROM INK SUPPLY PORT TO EJECTION OPENING | P1/Pth1 | TIME REQUIRED FOR PRELIMINARY EJECTION | INPUT ENERGY / ONE EJECTION OPENING |
|---|---|---|---|---|
| 5pl | 71μm | 1.10 | 0.08sec | 277μJ |
| | | 1.49 | 0.07sec | 348μJ |
| | | 2.06 | 0.07sec | 461μJ |
| SIZE OF INK DROPLET | DISTANCE FROM INK SUPPLY PORT TO EJECTION OPENING | P2/Pth2 | TIME REQUIRED FOR PRELIMINARY EJECTION | INPUT ENERGY / ONE EJECTION OPENING |
| 2pl | 123μm | 1.08 | 8.90sec | 22311μJ |
| | | 1.49 | 4.23sec | 14574μJ |
| | | 2.12 | 1.60sec | 7872μJ |
| SIZE OF INK DROPLET | DISTANCE FROM INK SUPPLY PORT TO EJECTION OPENING | P3/Pth3 | TIME REQUIRED FOR PRELIMINARY EJECTION | INPUT ENERGY / ONE EJECTION OPENING |
| 1pl | 75μm | 1.08 | 4.08sec | 8876μJ |
| | | 1.49 | 1.75sec | 5227μJ |
| | | 2.12 | 1.39sec | 5892μJ |

INK JET PRINTING APPARATUS AND CONTROL METHOD FOR REDUCING PRELIMINARY EJECTION

BACKGROUND OF THE INVENTION

1. Field of the Invention

The present invention relates to an ink jet printing apparatus and a preliminary ejection method, and specifically, to control of preliminary ejection for a print head having ejection openings with which ink paths of different lengths communicate.

2. Description of the Related Art

Ink jet printing apparatuses are known to execute recovery processes. The recovery processes discharge ink of increased viscosity, fine bubbles, or the like in a print head and remove foreign matter, ink mist, or the like attached to a surface on which ejection openings are formed. The recovery processes thus allows an ink ejection characteristic of the print head to be appropriately maintained. Known examples of the recovery process include suction recovery, preliminary ejection and wiping. The suction recovery is an operation of utilizing a negative pressure generated by a pump or the like to suck ink or bubbles out of the ejection openings of the print head. The preliminary ejection is an operation of performing ink ejection irrelevant to image formation so that the ink is ejected to a predetermined place other than print paper or onto the print paper, to discharge the ink and bubbles via the ejection openings of the print head. The wiping is an operation of using a blade to wipe the surface on which the ejection opening in the print head are formed, to remove the foreign matter, ink mist, or the like attached to the ejection opening forming surface.

The above-described ink of increased viscosity in the print head may particularly cause a reduction of ejection amount of ink, a deflection of ejected ink, or an ejection failure such as non-ejection. The ink of increased viscosity is likely to result from the lack of ejection over a long period. An example of the conventional recovery processes first performs the suction recovery to suck the ink of increased viscosity out of the ejection openings in the print head and then carries out the preliminary ejection. This enables color mixture resulting from the suction recovery to be eliminated. The recovery processes using such suction recovery has room to be improved because the suction recovery results in a relatively large amount of waste ink. In contrast, though an intensity of recovery is lower than that of the suction recovery, the preliminary ejection involves a relatively small amount of waste ink. Thus, the amount of waste ink can be reduced by, for example, replacing the suction recovery with the preliminary ejection. Furthermore, the preliminary ejection process requires a shorter time than the suction recovery process and is thus prevented from significantly affecting printing throughput.

As described above, among the ejection recovery processes, the preliminary ejection is relatively effective in terms of the amount of waste ink and the printing throughput. However, driving conditions for the preliminary ejection are desirably optimized in order to effectively achieve the preliminary ejection. That is, the adverse effect of the ink of increased viscosity on the ink ejection depends on the color or type of the ink and the amount of ejected ink. Thus, the driving conditions such as the number of ejected ink droplets, ejection frequency, and ejection interval are desirably optimized to allow the above-described advantages of the preliminary ejection to be fulfilled.

Japanese Patent Laid-Open No. 06-246931 (1994) discloses a configuration that sets the number of droplets ejected during the preliminary ejection is set depending on the type of the ink. That is, Japanese Patent Laid-Open No. 06-246931 (1994) describes a process of achieving just enough preliminary ejection by first determining the type of the ink, reading the number of ejected ink droplets corresponding to the determined type of the ink and setting the read number, and then performing the preliminary ejection.

Also, Japanese Patent Laid-Open No. 2004-090292 discloses a configuration that sets the driving conditions for the preliminary ejection, specifically, the number of ejected ink droplets, the ejection frequency, and the ejection interval, depending on the amount of ejected ink. Specifically, Japanese Patent Laid-Open No. 2004-090292 describes a process of setting the appropriate driving conditions for the respective ejection openings of different sizes to minimize the time required for the recovery process and the amount of discharged ink.

In recent years, print heads have been provided which includes nozzle arrays in each of which ejection openings (hereinafter also referred to as nozzles) are densely arranged in order to provide high-quality color photo images. In such a print head, an increase in resolution per nozzle array is effective for reducing the chip size of the print head. However, a high resolution of about 1,200 dpi per nozzle array makes it difficult to linearly arrange, for example, electro-thermal conversion elements for generating ejection energy, in connection with manufacture of the print head. Thus, the ejection openings in each of the nozzle arrays are, for example, staggered so that the staggered arrangement as a whole achieves such high resolution. In such a nonlinear ejection opening arrangement, a distance from an ink supply port common to the ejection openings to each of the ejection openings, for example, the length of an ink path communicating with the ejection opening, depends on the arrangement of the nozzle. Consequently, this arrangement involves the plural types of ejection openings with the different distances.

Of course, the preliminary ejection is desirably also optimized for such a print head involving a plurality of distances from the ink supply port common to the ejection openings to the respective ejection openings. That is, the adverse effect of the ink of increased viscosity on the ink ejection is expected to vary depending on the shape of the ink path or the like, specifically, the distance from the ink supply port to the ejection opening. Thus, the driving conditions for the preliminary ejection are desirably optimized according to the level of the adverse effect.

The number of ejections (number of ejected ink droplets) in the preliminary ejection is associated with the time required for the recovery process and the amount of discharged ink, and is thus an optimization index. The number of ejections in the preliminary ejection can be reduced by decreasing the viscosity of the ink of increased viscosity. For example, conventional techniques apply short pulses that are insufficient to allow ink ejection or drive sub-heaters which are different from the electro-thermal conversion elements and which do not directly relate to the ink ejection, to increase the temperature of the ink to reduce the viscosity thereof. However, the addition of a new driving circuit or the sub-heaters leads to an increase in chip size. This disadvantageously increases the size or costs of the print head.

To solve this problem, the ink viscosity can be reduced by controlling, as a parameter, the ratio (E/Eth) of lower limit energy Eth supplied to the electro-thermal conversion elements and required for ejection to energy E supplied for actual ejection. That is, setting the ratio E/Eth to be equal to or greater than a certain value is known to be effective for increasing the temperature of the ink to reduce the viscosity of the ink of increased viscosity

SUMMARY OF THE INVENTION

An object of the present invention is to provide an ink jet printing apparatus and an ink ejection control method which enable optimization of preliminary ejection for a print head involving a plurality of distances from an ink supply port common to ejection openings to the respective ejection openings, using the above-described energy ratio as a parameter.

In the first aspect of the present invention, there is provided an ink jet printing apparatus that performs printing by using a print head provided with ejection openings for ejecting inks and heaters to which pulses are applied for generating thermal energy to eject ink, the apparatus comprising: driving means for applying the pulse having energy to the heater for ejecting ink; and preliminary ejection means for causing the driving means to eject the ink from the print head in a recovery operation for the print head other than a printing operation, wherein the print head is provided with a first ejection opening and a second ejection opening, and a distance from an ink supply port common to the first and second ejection openings to the second ejection opening is greater than a distance from the ink supply port to the first ejection opening, and the driving means applies the pulses which meet a condition that a ratio (E2/Eth2) is greater than a ratio (E1/Eth1) in which Eth1 and Eth2 are lower limit energies supplied to the heater and required for ink ejection through the first and the second ejection openings respectively and E1 and E2 are energies supplied to the heater for ink ejection by the preliminary ejection means through the first and the second ejection openings respectively, in the ink ejection by the preliminary ejection means.

In the second aspect of the present invention, there is provided an ink ejection control method of an ink jet printing apparatus that performs printing by using a print head provided with ejection openings for ejecting inks and heaters to which pulses are applied for generating thermal energy to eject ink, the method comprising the steps of: a preliminary ejection step for ejecting the ink from the print head in a recovery operation for the print head other than a printing operation, wherein the preliminary ejection step applies the pulse having energy to the heater for ejecting ink, the print head is provided with a first ejection opening and a second ejection opening, and a distance from an ink supply port common to the first and second ejection openings to the second ejection opening is greater than a distance from the ink supply port to the first ejection opening, and the preliminary ejection step applies the pulses which meet a condition that a ratio (E2/Eth2) is greater than a ratio E1/Eth1) in which Eth1 and Eth2 are lower limit energies supplied to the heater and required for ink ejection through the first and the second ejection openings respectively and E1 and E2 are energies supplied to the heater for ink ejection by the preliminary ejection means through the first and the second ejection openings respectively, in the ink ejection in the preliminary ejection step.

According to the above-described configuration, when performing the preliminary ejection, for first and second ejection openings with different distances from the ink supply port to the ejection opening, the ratio of the pulse width P2 to the lower limit pulse width Pth for the second ejection opening with the longer distance is set to be greater than the ratio P1/Pth1 for the first ejection opening with the shorter distance. This enables a reduction in the time required for preliminary ejection of the apparatus as a whole. Furthermore, the pulse width ratio for the nozzle array with the shorter distance avoids being set to a greater value than necessary. Thus, a possible increase in input energy can be prevented, contributing to energy saving in the apparatus. Thus, the pulse width ratio may be set to be greater for the ejection opening with the longer distance from the end of the ink supply port to the ejection openings, and for example, the number of ink droplets preliminarily ejected through each ejection opening can be set on the basis of the pulse width ratio.

As a result, the present invention enables the optimization of the preliminary ejection for the print head involving the plurality of distances from the ink supply port to the respective ejection openings.

BRIEF DESCRIPTION OF THE DRAWINGS

FIG. 6 is a diagram illustrating the results of determination of the number of preliminarily ejected ink droplets according to the first embodiment;

FIG. 7 is a diagram illustrating the results of determination of input energy for the preliminary ejection according to the first embodiment;

FIG. 10 is a diagram illustrating the results of determination of time required for preliminary ejection and the like according to the second embodiment of the present invention.

DESCRIPTION OF THE EMBODIMENTS

Embodiments of the present invention will be described below with reference to the drawings.

Figure 2A:
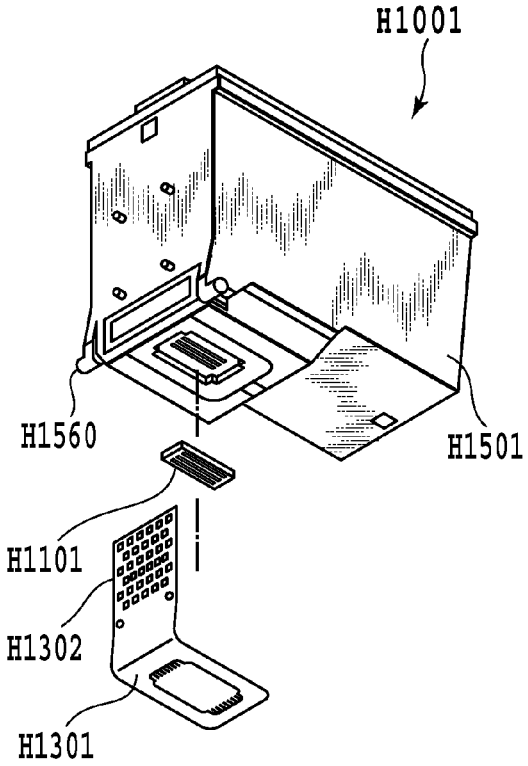
FIGS. 2A and 2B are diagrams illustrating the print head according to the embodiment of the present invention.
Figure 2B:
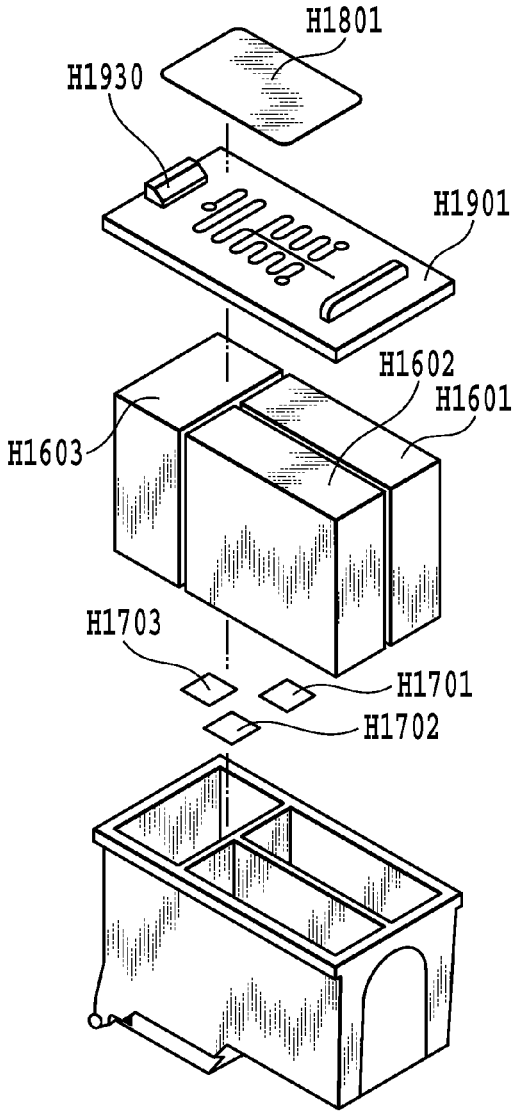
Figure 3:
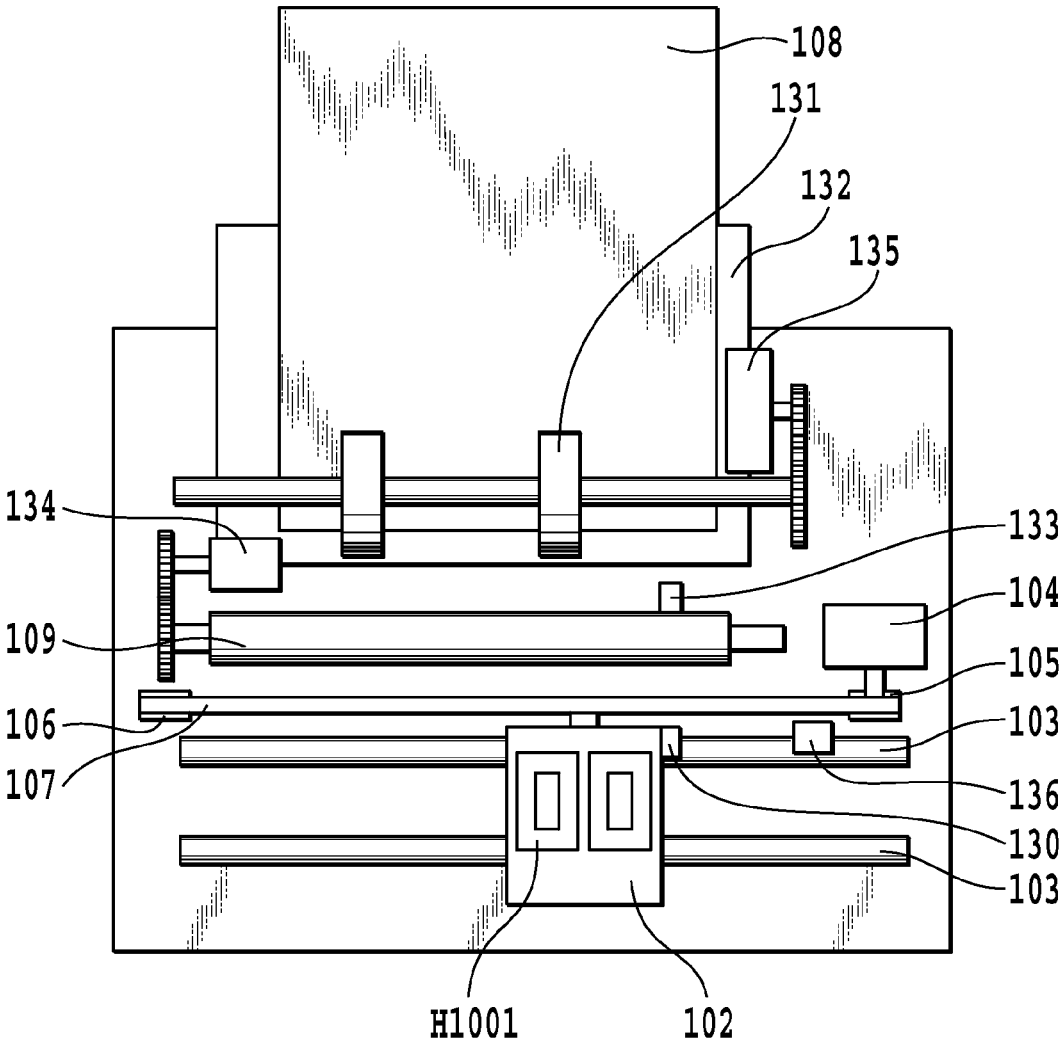
FIG. 3 is a diagram illustrating an example of an ink jet printing apparatus in which the print head can be mounted.

FIGS. 1 to 3 are diagrams illustrating an ink jet print head according to an embodiment of the present invention. Components of the ink jet print head will be described below with reference to the drawings.

Ink Jet Print Head

An ink jet print head H1001 according to the present embodiment is based on a bubble jet (registered trade mark) scheme using electro-thermal conversion elements (also referred as heaters) that generate thermal energy required to cause film boiling in ink, in response to an applied electric signal. The print head is of what is called a side shooter type in which the electrothermal conversion element is arranged opposite ejection opening through which ink droplets are ejected.

The illustrated ink jet print head H1001 includes respective nozzle arrays through which color inks of yellow, cyan, and magenta are ejected. As shown in FIGS. 2A and 2B, the print head H1001 has a print element substrate H1101, an electric wiring tape H1301, an ink supply holding member H1501, filters H1701, H1702, and H1703, ink absorbents H1601, H1602, and H1603, a cover member H1901, and a seal member H1801.

Mounting of the Ink Jet Print Head on the Ink Jet Printing Apparatus

Figure 1A:
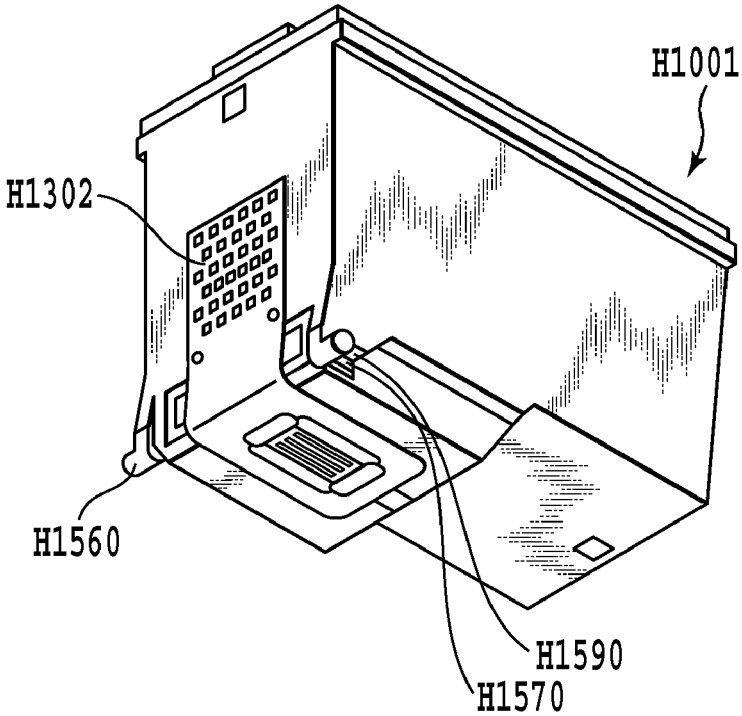
FIGS. 1A and 1B are diagrams illustrating a print head according to an embodiment of the present invention.
Figure 1B:
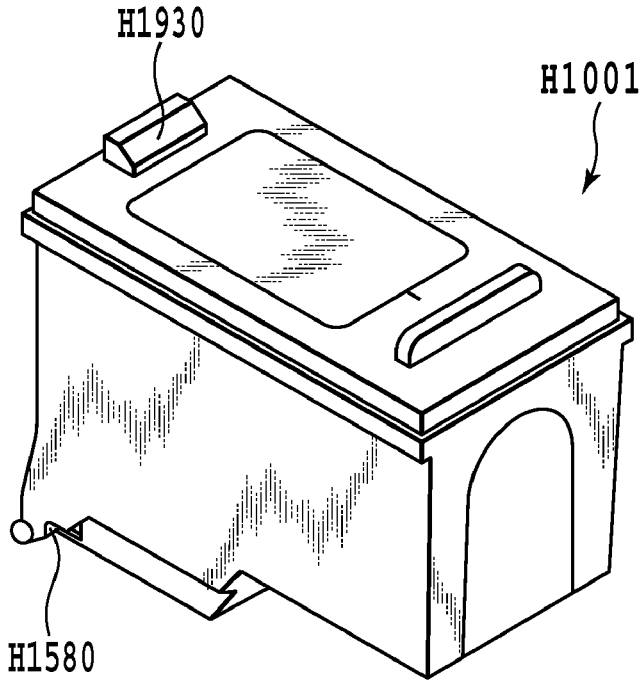

As shown in FIGS. 1A and 1B, the ink jet print head H1001 includes a mounting guide H1560 that allows the print head to be guided to a mounting position on a carriage in the ink jet printing apparatus main body, and an engagement portion H1930 that allows the print head to be fixedly mounted on the carriage via a headset lever. The ink jet print head H1001 includes an X direction (carriage scan direction) abutting portion H 1570 that allows the print head to be positioned at a predetermined installation position on the carriage, a Y direction (printed member conveying direction) abutting portion H1580, and a Z direction (ink ejecting direction) abutting portion H1590. The positioning via the abutting portions allows external signal input terminals H1302 on an electric wiring tape H1301 to electrically contact pins in an electric connection portion accurately.

Ink Jet Printing Apparatus

FIG. 3 is a diagram illustrating an example of a printing apparatus in which the above-described cartridge type print head can be mounted. In the printing apparatus shown in FIG. 3, the ink jet print head H1001 shown in FIG. 2 is replaceably mounted so as to be positioned on the carriage 102. The carriage 102 includes the electric connection portion that allows driving signals and the like to be transmitted to respective ejection parts via the external signal input terminals on the ink jet print head H1001.

The carriage 102 is guided and supported so as to be reciprocatable along a guide shaft 103 installed in the apparatus main body so as to extend in a main scanning direction. The carriage 102 is driven and has the position and movement thereof controlled, by a main scanning motor 104 via driving mechanisms such as a motor pulley 105, a driven pulley 106, and a timing belt 107. Furthermore, a home position sensor 130 is provided on the carriage 102. Thus, a home position is detected when the home position sensor 130 on the carriage 102 passes the blocking plate 136.

A print medium 108 such as a print sheet or a plastic thin plate is separately fed from an auto sheet feeder (ASF) 132 one by one by transmitting a driving force of a sheet feeding motor 135 to a pickup roller 131 via gears to rotate the pickup roller 131. The print medium 108 is further conveyed (sub-scanning), by rotation of a conveying roller 109, through a position (print part) located opposite an ejection opening surface of the ink jet print head H 1001. The conveying roller 109 is rotated by transmission of rotation of an LF motor 134 via a gear, to convey the print medium. In this case, determination of whether or not the print medium has been fed and determination of a head search position for sheet feeding are performed when the print medium 108 passes a paper end sensor 133. Moreover, the paper end sensor 133 is used to determine where a trailing end of the print medium 108 is actually located to finally determine the current print position on the basis of the actual trailing end.

The print medium 108 is supported by a platen (not shown in the drawings) at a back surface thereof so as to form a flat print surface in the print part. In this case, the ink jet print head H1001 mounted on the carriage 102 is held such that the ejection opening surface of the ink jet print head H1001 projects downward from the carriage 102 and parallel to the print medium 108 between the two pairs of conveying rollers.

The ink jet print head H1001 is mounted on the carriage 102 so that a direction in which the ejection openings are arranged crosses a scanning direction of the carriage 102. Ink is ejected through the ejection openings for printing.

Figure 4:
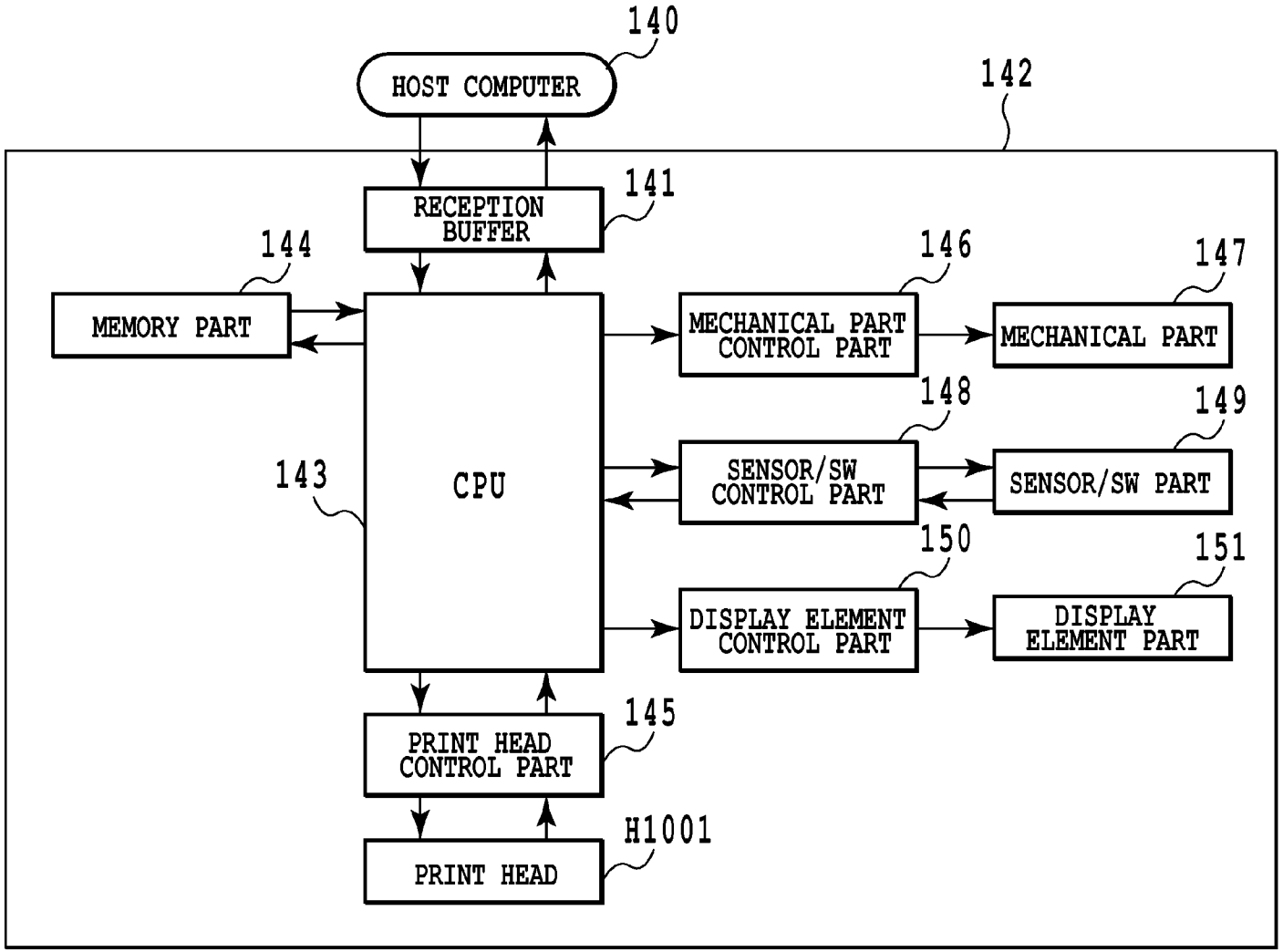
FIG. 4 is a block diagram showing the configuration of data processing and control of elements in the ink jet printing apparatus.

FIG. 4 is a block diagram showing the configuration of data processing and control of elements in the above-described ink jet printing apparatus. A host computer 104 transfers data such as a text or an image to be printed, in a format used for the print head. The data is stored in a reception buffer 141. An ink jet printing apparatus 142 transmits data indicating whether or not the data has been correctly transferred, data indicating the operating condition of an ink jet printing apparatus 142, to a host computer 140. The data stored in the reception buffer 141 is transferred to a memory part 144 under the control of a CPU 143 and temporarily stored in a RAM of the memory part 144. The CPU 143 performs control such that the data is sent to a print head control part 145 at a predetermined timing. According to the data, the print head control part 145 drives the print head H1001 to eject ink droplets. The CPU 143 executes processing such as control for a recovery process such as preliminary ejection described below with reference to FIG. 8. The memory part 144 is used as a work area for the processing. A mechanical part control part 146 drivingly controls a mechanical part 147 such as the LF motor on the basis of instructions from the CPU 143. A sensor/SW control part 148 sends signals from a sensor/SW part 149 made up of various sensors and SWs (switches), to the CPU 143. A display element control part 150 is configured to control a display part made up of LEDs, liquid crystal display elements, and the like in a display panel group in accordance with instructions from the CPU 143. As described above, the print head control part 145 controls an operation of ejecting ink droplets from the print head H1001 on the basis of instructions from the CPU 143. The print head control part 145 detects and sends temperature information and the like indicating the condition of the print head H1001, to the CPU 143.

First Embodiment

A first embodiment of the present invention relates to a control for optimizing preliminary ejection when a print head is used which involves two types of distances from an ink supply port common to the ejection openings to the respective ejection openings. The first embodiment uses the ratio of pulse width as a parameter of the above-described energy ratio. Specifically, with the voltage of a pulse applied to the electro-thermal conversion elements held constant, the value of the ratio (P/Pth) of a lower limit pulse width Pth required for ejection to a driving pulse width P is used as a parameter.

A method of measuring the lower limit pulse width Pth required for ejection is as follows. Ink ejection driving is performed with the driving pulse width varied from 0.300 μsec to 1.000 μsec at 0.020 μsec increments. A measuring pattern is thus printed. A pulse width of the pattern at which ink is firstly determined to be ejected through all the ejection openings making up the nozzle array is defined as the lower limit pulse width Pth.

Figure 5A:
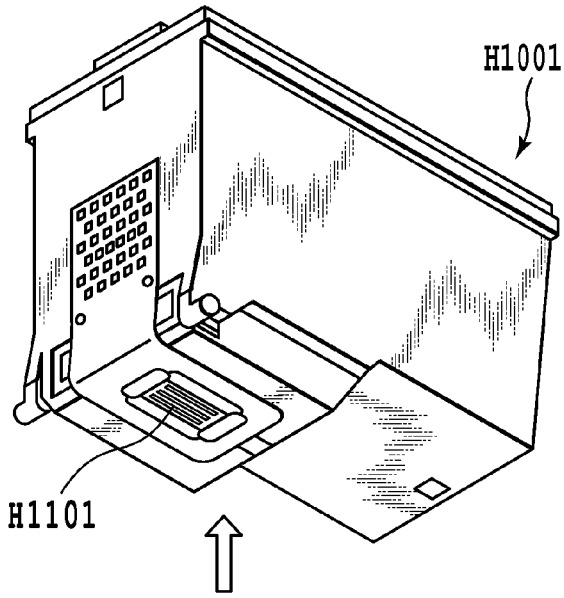
FIGS. 5A and 5B are diagrams showing arrangement of nozzle arrays in a print head according to a first embodiment of the present invention.
Figure 5B:
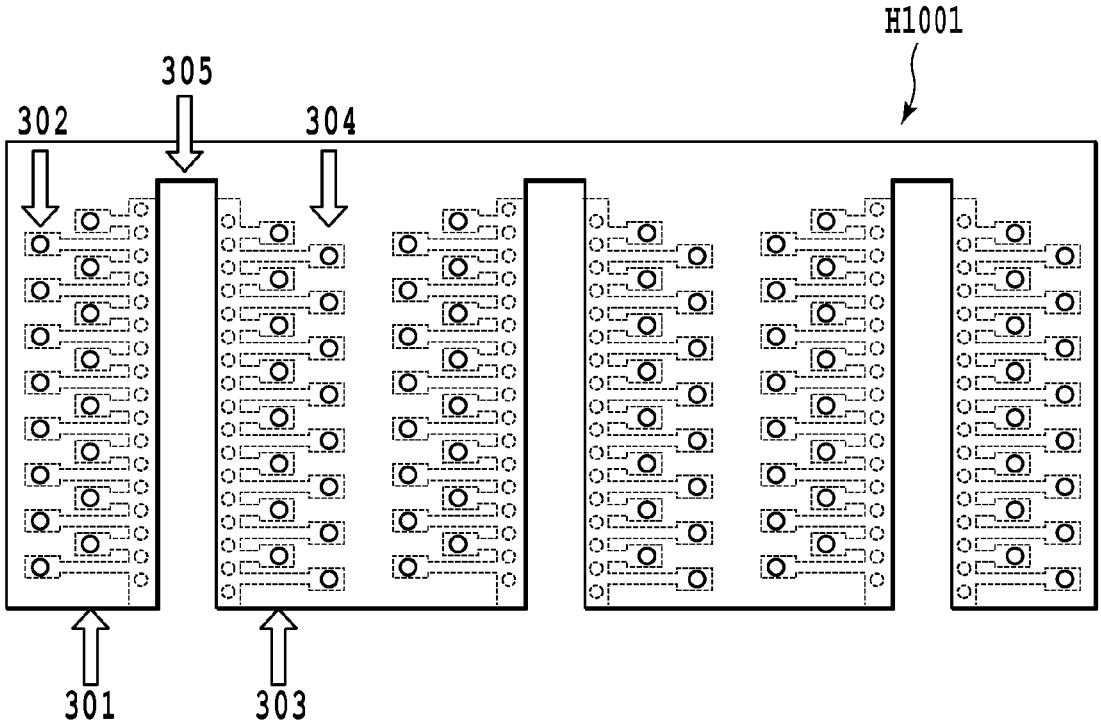

FIG. 5B is a diagram showing the arrangement of the ejection openings wherein a print element substrate H1101 forming the ink jet print head H1001 shown in FIG. 5A is observed from the direction of an arrow in FIG. 5A. In FIG. 5B, ink supply paths described below and otherwise shown by dashed lines are shown by solid lines for simplification.

As shown in FIG. 5B, a first nozzle array 301 and a second nozzle array 302 are arranged on the same side of an ink supply port 305; the first nozzle array 301 is made up of ejection openings through which ink droplets each of 2 pl can be ejected, and the second nozzle array 302 is also made up of second ejection openings through which ink droplets each of 2 pl can be ejected. Each of the first nozzle array 301 and the second nozzle array 302 has an ejection opening arrangement density of 600 dpi. In each array, the ejection openings are arranged at intervals of about 25.4 mm/6000.0423 mm. The second nozzle array 302 is displaced from the first nozzle array 302 by 0.0212 mm (half of an arrangement pitch) in an array direction. A third nozzle array 303 and a fourth nozzle array 304 are arranged opposite the first and second nozzle arrays with respect to the ink supply port; ink droplets each of 2 pl can be ejected through the third nozzle array 303 and similarly through the fourth nozzle array 304. Each of the third nozzle array 303 and the fourth nozzle array 304 similarly has an ejection opening arrangement density of 600 dpi. The ejection openings are arranged at intervals of about 25.4 mm/6000.0423 mm. The fourth nozzle array 304 is displaced from the third nozzle array 303 by 0.0212 mm in the array direction. The third nozzle array 303 is displaced from the first nozzle array 301 by 0.0106 mm in the array direction. That is, in the entire arrangement, the four nozzle arrays arranged across the ink supply port 305 are arranged at a density of 2,400 dpi as a whole in the array direction.

FIG. 5B shows the configuration including three sets each of the first to fourth nozzle arrays. With reference to FIG. 5B, an example will be described in which the three sets of nozzle arrays are used for cyan ink, magenta ink, and yellow ink, respectively. That is, the different types of inks are fed through the three ink supply ports. For each color ink, the ejection openings in the first nozzle array 301 and the third nozzle array 303 are formed 75 μm away from respective ends of the ink supply port 305. The ejection openings in the second nozzle array 302 and the fourth nozzle array 304 are formed 123 μm away from the respective ends of the ink supply port 305. That is, in the print head according to the present embodiment, two types of distances from the ink supply port common to the ejection openings to the respective ejection openings are available for each color ink.

The ejection openings making up the four nozzle arrays for each color are each formed to have a cross-section area such that an ink droplet of 2 pl can be ejected through the ejection opening. The size of an ink path communicating with the ejection openings and the size of the electro-thermal conversion element are adjusted to the cross-section area of the ejection opening. The width of the ink path making up each of the first nozzle array 301 and the third nozzle array 303 is almost the same as that of the ink path making up each of the second nozzle array 302 and the fourth nozzle array 304. All the nozzle arrays are parallel to one another.

For the above-described print head, the number of preliminarily ejections (number of ejected ink droplets) required for a recovery process is determined as described below with reference to FIG. 6. At this time, with the ejection opening forming surface not covered, that is, with the ejection openings exposed to the atmosphere, the print head was left in an environment maintained at 40° C. for one week. In this case, it is assumed that a user removes the print head from the ink jet printing apparatus for any reason, leaves the removed print head in the atmosphere over a long period, and then reuse the print head. The print head is used to perform the preliminary ejection with a preliminary ejection driving condition, specifically, the driving pulse width varied. At each driving pulse width, the following are determined: the number of ejected ink droplets required to establish a normal ejection condition in which possible deviation or non-ejection of ink is prevented, as well as the time required for the normal ejection.

In a condition of increased viscosity of the ink and the like not occurring, the lower limit pulse width (hereinafter referred to as Pth1) required to eject the ink through the nozzles in the first nozzle array 301 and the lower limit pulse width (hereinafter referred to as Pth2) for the second nozzle array 302 are both 0.469 μsec. During the preliminary ejection, the driving pulse widths (hereinafter referred to as P1 and P2) required to eject the ink through the first nozzle array 301 and the second nozzle array 302 have three types of values, 0.508 μsec, 0.698 μsec, and 0.994 μsec. In this case, the ratios (P1/Pth1) and (P2/PTh2) of the lower limit pulse width to the driving pulse width have three types of values, 1.08, 1.49, and 2.12.

FIG. 6 is a diagram showing the results of determination of the number of preliminary ejections (the number of ink droplets ejected in the preliminary ejection) and a preliminary ejection time (time required for preliminary ejection), for the cyan ink under the above-described driving conditions. In FIG. 6, the number of preliminarily ejections shows the number of ink droplets ejected per ejection opening. The preliminary ejection time is the time required only for the preliminary ejection.

As seen in FIG. 6, for the first nozzle array 301, in which the distance from the end of the ink supply port to the ejection openings is 75 μm, the number of preliminarily ejections required to establish the normal ejection condition decreases with increasing pulse width ratio (P1/Pth1). It is inferred from this that an increase in the value of the pulse width ratio (P1/Pth1) raises the temperature of the ink, thus reducing the viscosity of the ink of increased viscosity. Similarly, for the second nozzle array 302, in which the distance from the end of the ink supply port to the ejection openings is 123 μm, the number of preliminarily ejections required to establish the normal ejection condition decreases with increasing pulse width ratio (P2/Pth2). This may come from a similar reason to the above.

For the first nozzle array 301, when the value of the pulse width ratio (P1/Pth1) varies from 1.08 to 2.12, the preliminary ejection time varies by about 2 sec. In contrast, for the second nozzle array 302, which involves the longer distance from the ink supply ports to the ejection openings, when the value of the pulse width ratio (P2/Pth2) is 1.08, the normal ejection condition cannot be established even when the number of preliminarily ejections is 100,000. This significantly increases the preliminary ejection time. It is inferred from this that the distance from the ink supply port to the ejection openings profoundly affects the increased viscosity of the ink or the recoverability of the ink of increased viscosity. However, when the value of the pulse width ratio (P2/Pth2) is 2.12, the preliminary ejection time required to recover the normal ejection condition is 1.75 sec. That is, the effect of an increase in pulse width in the pulse width ratio (P/Pth) is more significant for the nozzle array with the longer distance from the ink supply port to the ejection openings.

FIG. 7 is a diagram showing the relationship between the pulse ratio (P/Pth) and the amount of energy input per ejection opening, wherein the ink is ejected through the first and second nozzle arrays for the cyan ink under the driving conditions shown in FIG. 6. The input energy is obtained by calculating the product of the driving pulse width P1 or P2, driving voltage, driving current, and the number of preliminarily ejections, during the preliminary ejection. In the present embodiment, the driving voltage is 24 V, and the driving current is 0.031 A.

As shown in FIG. 7, for the second nozzle array 302, in which the distance from the end of the ink supply port to the ejection openings is 123 μm, not only the number of preliminarily ejections but also the input energy decreases with increasing pulse width ratio (P2/Pth2).

In contrast, for the first nozzle array 301, in which the distance from the end of the ink supply port to the ejection openings is 75 μm, the number of preliminarily ejections decreases until the value of the pulse width ratio (P1/Pth1) reaches 1.49. The input energy also decreases consistently with the value of the pulse width ratio (P1/Pth1), but when the value of the pulse width ratio (P1/Pth1) is 2.12, the input energy increases.

The following discussion is based on the relationship among the parameter (P/Pth), the number of preliminarily ejections, the preliminary ejection time, and the input energy, shown in FIGS. 6 and 7, described above.

If the pulse width ratio (P/Pth) is set to the same value for the first and second nozzle arrays, the second nozzle array requires a longer time required for the preliminary ejection. That is, for an apparatus using a print head including such two types of nozzle arrays, the preliminary ejection time of the apparatus corresponds to the longer time required for the preliminary ejection for the nozzle array with the longer distance from the end of the ink supply port to the ejection openings. In this connection, the value of the pulse width ratio (P1/Pth1) is set to be different from that of the pulse width ratio (P2/Pth2). In this case, as is apparent from FIG. 6, the value of the pulse width ratio (P2/Pth2) is set to be larger than that of the pulse width ratio (P1/Pth1) to reduce the time required for preliminary ejection of the apparatus. More specifically, if the value of the pulse width ratio (P1/Pth1) is the same as that of the pulse width ratio (P2/Pth2), the time required for preliminary ejection corresponding to the pulse width ratio (P1/Pth1) is shorter as described above. Thus, the time required for preliminary ejection can be reduced by setting the value of the pulse width ratio (P1/Pth2) to be larger than that of the pulse width ratio (P2/Pth1). As a result of this, the preliminary ejection time of the apparatus can be reduced as a whole.

Furthermore, as shown in FIG. 7, for the nozzle array with the shorter distance from the end of the ink supply port to the ejection openings, setting the pulse width ratio (P1/Pth1) to a greater value than necessary may increase the input energy. This indicates that setting the pulse width ratio (P/Pth) equal to or larger than a certain value prevents the number of ejections required for the recovery operation from being effectively reduced. That is, preferably, the driving pulse is set on the basis of the relationship between the pulse width ratio (P/Pth) and the number ejections required for the recovery operation, with a reduction in energy consumed by the apparatus taken into account.

As described above, preferably, the pulse width ratio (P/Pth) is set to a larger value for the nozzle array with the longer distance from the end of the ink supply port to the ejection openings, in order to improve throughput and to save energy.

The above description with reference to FIGS. 6 and 7 relates to the cyan ink. However, this tendency also applies to the magenta ink and the yellow ink in spite of some difference in degree.

Figure 8:
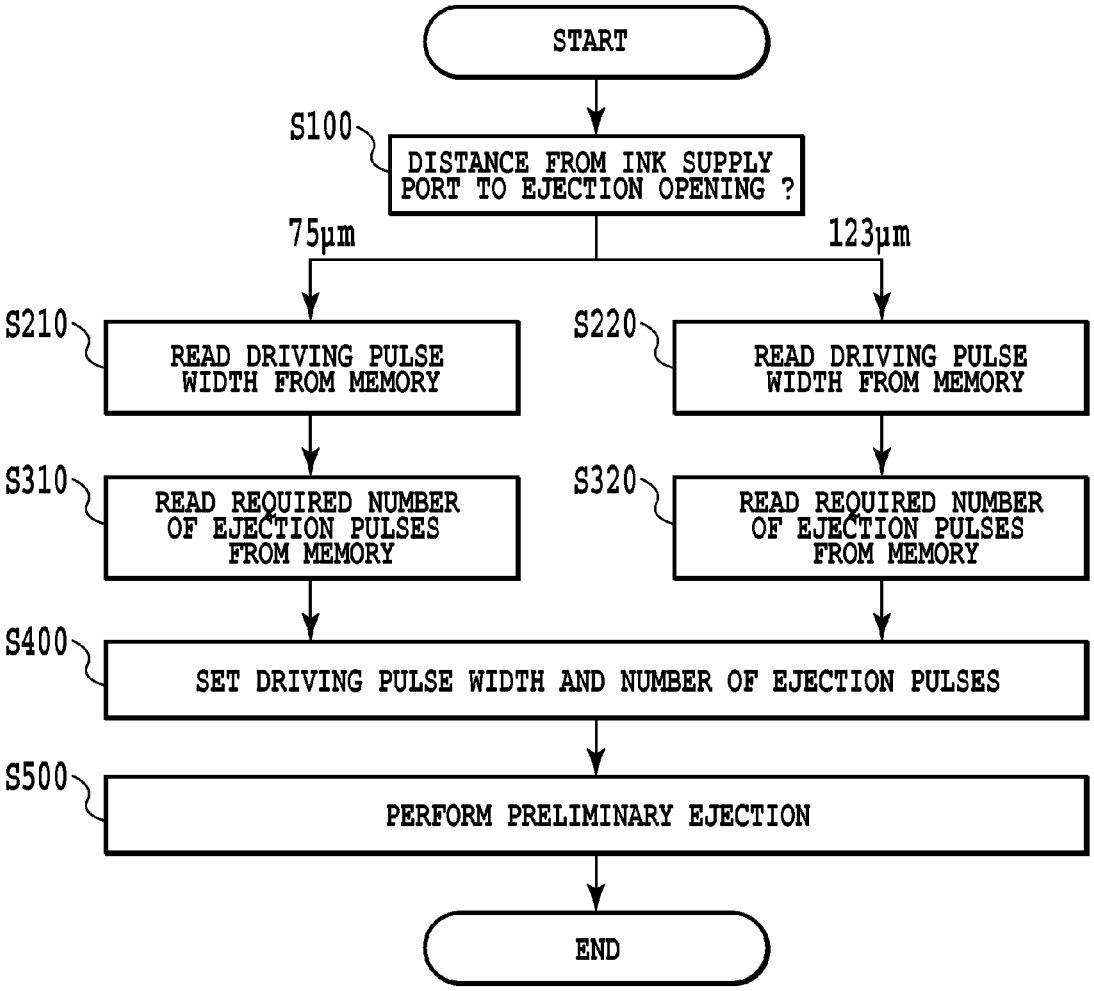
FIG. 8 is a flowchart showing preliminary ejection control according to the first embodiment of the present invention.

FIG. 8 is a flowchart of preliminary ejection control using the different parameters (P/Pth) for the respective nozzle arrays with different ink path lengths, which parameters are set as described above.

When the control is started, in step S100, the apparatus determines the distance from the ink supply port to the ejection openings in each of the nozzle arrays in the print head to be subjected to the preliminary ejection. That is, for the above-described print head, the distance is determined to be 75 μm or 123 μm. Then, in steps S210 and S220, for each of the determined distances, the driving pulse width for the preliminary ejection is read from the memory. The pulse width is such that the lower limit pulse width Pth1 and driving pulse width P1 corresponding to the distance of 75 μm and the lower limit pulse width Pth2 and driving pulse width P2 corresponding to the distance of 123 μm meet pulse width ratio (P2/Pth2)>pulse width ratio (P1/Pth1) as described above.

Moreover, in steps S310 and S320, for each of the determined distances, the number of ejection pulses (the number of preliminary ejections) required for the preliminary ejection is read from the memory. In step S400, the read driving pulse width and number of ejection pulses are set in the memory. Then, in step S500, the preliminary ejection is performed on the basis of the conditions set in step S400. Thus, the present preliminary ejection control routine is completed.

As described above, when the print head involves plural types, in the present embodiment, two types of distances from the ink supply port to the ejection openings, the driving conditions are set such that the ratio of the lower limit pulse width to the driving pulse width for the preliminary ejection for each distance increases consistently with the distance. This enables improvement of the throughput and energy saving.

Second Embodiment

A second embodiment of the present invention relates to setting of the driving conditions for the preliminary ejection such that the throughput can be improved, when a print head is used which involves three types of distances from the ink supply port to the ejection openings and which ejects ink droplets of three types of sizes. Also in the present embodiment, with the driving voltage maintained constant, the driving conditions are determined using the ratio (P/Pth) of the lower limit pulse width Pth required for ejection to the driving pulse width P, as a parameter.

Figure 9A:
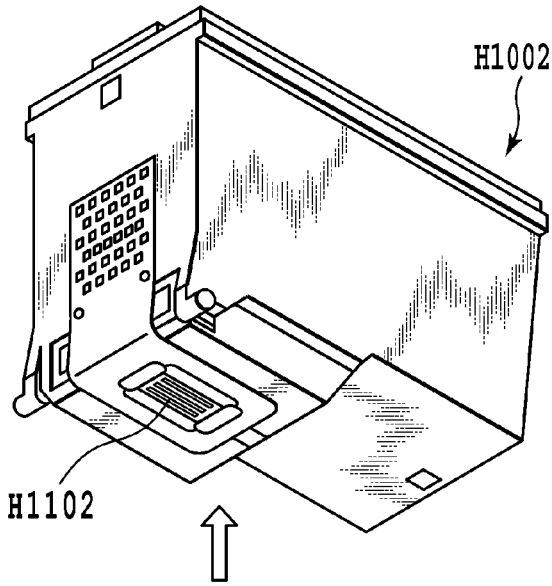
FIGS. 9A and 9B are diagrams showing the arrangement of nozzle arrays according to a second embodiment of the present invention.
Figure 9B:
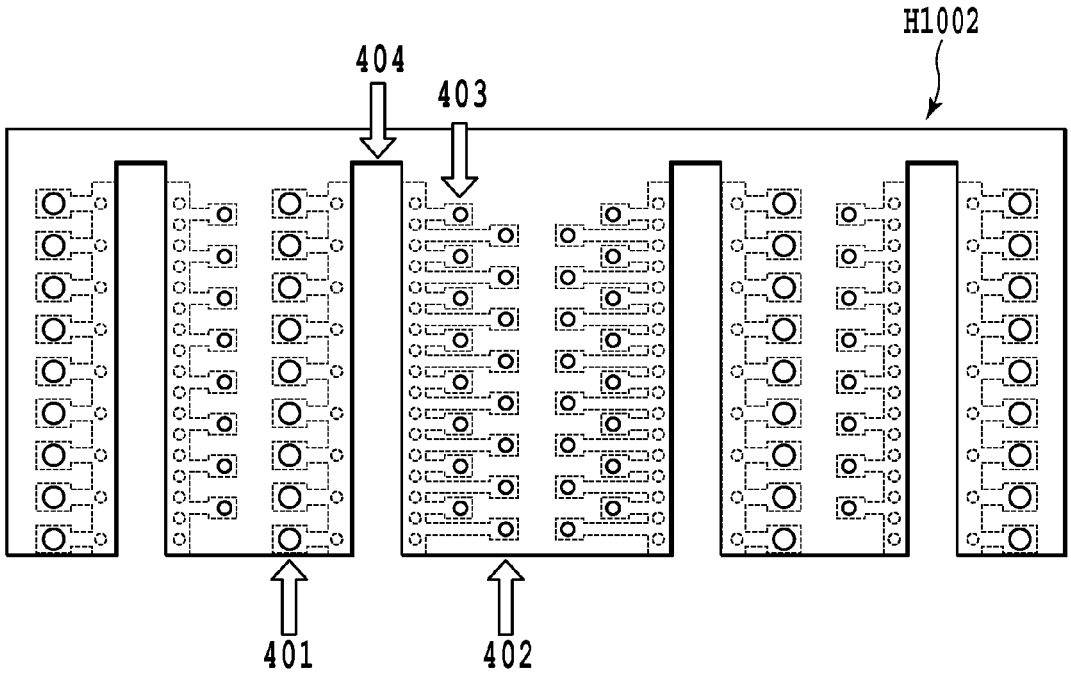

FIG. 9B is a diagram showing the arrangement of the ejection openings wherein a print element substrate H1102 forming a print head H1002 according to the present embodiment is observed from the direction of an arrow shown in FIG. 9A. A first nozzle array 401, a second nozzle array 402, and a third nozzle array 403 are formed via an ink supply port 404; ink droplets each of 5 pl are ejected through the first nozzle array 401, ink droplets each of 2 pl are ejected through the second nozzle array 402, and ink droplets each of 1 pl are ejected through the third nozzle array 403. Each of the first nozzle array 401, the second nozzle array 402, and the third nozzle array 403 has an ejection opening arrangement density of 600 dpi. The ejection openings are arranged at intervals of about 25.4 mm/600≈0.0423 mm. The first nozzle array 401 and the second nozzle array 402 are disposed so as to be symmetric with respect to the ink supply port 404. The third nozzle array 403 is displaced from the second nozzle array 402 by 0.0212 mm in the array direction. In the first nozzle array 401, the ejection openings are formed 71 μm away from the end of the ink supply port 404 common to the nozzle arrays. In the second nozzle array 402, the ejection openings are formed 123 μm away from the end of the ink supply port 404. In the third nozzle array 403, the ejection openings are formed 75 μm away from the end of the ink supply port 404.

The ejection openings making up the first nozzle array 401 are each formed to have a sectional area such that an ink droplet of 5 μl can be ejected through the ejection opening.

The size of the ink path communicating with the ejection openings and the size of the electro-thermal conversion element are adjusted to the sectional area of the ejection opening. The ejection openings making up the second nozzle array 402 are each formed to have a sectional area such that an ink droplet of 2 pl can be ejected through the ejection opening. The size of the ink path communicating with the ejection openings and the size of the electro-thermal conversion element are adjusted to the sectional area of the ejection opening. The ejection openings making up the third nozzle array 403 are each formed to have a sectional area such that an ink droplet of 1 pl can be ejected through the ejection opening. The size of the ink path communicating with the ejection openings and the size of the electro-thermal conversion element are adjusted to the sectional area of the ejection opening. The width of the ink path making up the second nozzle array 402 is almost the same as that of the ink path making up the third nozzle array 403.

In addition, the print element substrate H1102, which forms the ink jet print head H1002, includes a sub-heater formed of Al wiring as means for reducing increased viscosity of the ink. The sub-heater is driven so that when an ink droplet is ejected, ink is heated at a predetermined temperature. In this case, a very high temperature is required to reduce the viscosity of the ink of increased viscosity, which may cause inappropriate ink ejection such as non-ejection as described above, simply by using the sub-heater to heat the ink. This is not preferable in terms of energy saving. Thus, to reduce the viscosity of the ink of increased viscosity in the vicinity of the ejection openings, the preliminary ejection is performed so as to increase the pulse width ratio (P/Pth) as shown in the first embodiment, to increase the temperature of the ink. That is, the heating by the sub-heater according to the present embodiment is not intended to reduce the viscosity of the ink of increased viscosity alone but to reduce the viscosity of the ink in the entire ink jet print head, including the ink supply and holding members. In the present embodiment, immediately before the preliminary ejection, the sub-heater is driven so as to allow a sensor provided on the print element substrate H1102 to read a temperature of 40° C. All the nozzle arrays are parallel to one another, and different types of inks can be fed through the four ink supply ports. In the arrangement of the ink supply ports shown in FIG. 9B, black, cyan, magenta and yellow inks starting from the left are supplied through the respective supply ports. That is, the above-described first, second, and third nozzle arrays are provided for each of cyan and magenta inks.

For this print head, for example, the preliminary ejection time required for the recovery process is determined as described later with reference to FIG. 10. The print head is like to that in the first embodiment, and the preliminary ejection is performed with a preliminary ejection driving condition, specifically, the driving pulse width varied. Then, at each driving pulse width, the ejection time required to establish the normal ejection condition is determined.

Specifically, with increased viscosity of the ink and the like not occurring, the lower limit pulse width (hereinafter referred to as Pth1) for the first nozzle array 401 is 0.483 μm. The lower limit pulse widths (hereinafter referred to as Pth2 and Pth3) for the second nozzle array 402 and the third nozzle array 403 are both 0.469 μsec. During the preliminary ejection, the driving pulse width (hereinafter referred to as P1) required to eject the ink through the first nozzle array 401 has three types of values, 0.529 μsec, 0.719 μsec, and 0.994 μsec. In this case, the ratio (P1/Pth1) of the driving pulse width to the lower limit pulse width has three types of values, 1.10, 1.49, and 2.06. The driving pulse widths (hereinafter referred to as P2 and P3) required to eject the ink through the second nozzle array 402 and the third nozzle array 403 have three types of values, 0.508 μsec, 0.698 μsec, and 0.994 μsec. In this case, the ratios (P2/Pth2) and (P3/Pth3) of the driving pulse width to the lower limit pulse width have three types of values, 1.08, 1.49, and 2.12.

FIG. 10 is a diagram showing the results of determination of the time required for preliminary ejection for the cyan ink. As shown in FIG. 10, for the first nozzle array 401, through which ink droplets each of 5 pl are ejected and in which the distance from the end of the ink supply port to the ejection openings is 71 μm, the time required for preliminary ejection required to establish the normal ejection condition is prevented from varying significantly even with an increase in pulse width ratio (P1/Pth1). This is expected to be because the ejection opening through which an ink droplet with a size amounting to 5 pl is ejected is relatively large and is unlikely to be affected by the ink of increased viscosity. On the other hand, for the second nozzle array 402, through which ink droplets each of 2 pl are ejected and in which the distance from the end of the ink supply port to the ejection openings is 123 μm, the preliminary ejection time required to establish the normal ejection condition decreases with increasing of pulse width ratio (P2/Pth2). This is expected to be because an increase in pulse width ratio (P2/Pth2) increases the temperature of the ink to reduce the viscosity of the ink of increased viscosity. For the third nozzle array 403, through which ink droplets each of 1 pl are ejected and in which the distance from the end of the ink supply port to the ejection openings is 75 μm, the preliminary ejection time required to establish the normal ejection condition decreases with increasing of pulse width ratio (P3/Pth3). This is similarly expected to be because an increase in pulse width ratio (P3/Pth3) increases the temperature of the ink to reduce the viscosity of the ink of increased viscosity. In general, the reduced size of ink droplets makes the preliminary ejection time likely to be affected by the ink of increased viscosity. However, the increased distance from the ink supply port to the ejection openings causes the preliminary ejection time to be further affected by the ink of increased viscosity.

FIG. 10 also shows the results of determination of the pulse width ratio (P/Pth) and the energy input per ejection opening for the first, second, and third nozzle arrays in the case of the cyan ink. The input energy is obtained by calculating the product of the driving pulse width, the driving voltage, the driving current, and the number of ejected ink droplets during the preliminary ejection. In the present embodiment, the driving voltage is 24 V. The driving currents for the first, second, third nozzle arrays are 0.042 A, 0.030 A, and 0.026 A, respectively. For the first nozzle array, an increase in pulse width ratio (P1/Pth1) does not significantly vary the preliminary ejection time but increases the input energy. For the second nozzle array, an increase in pulse width ratio (P2/Pth2) reduces the preliminary ejection time and the input energy. For the third nozzle array, the preliminary ejection time and the input energy decrease until the value of the pulse width ratio (P3/Pth3) reaches 1.49. However, when the value of the pulse width ratio (P3/Pth3) is 2.12, the input energy increases.

The following discussion is based on the relationship between the parameter (P/Pth) and the preliminary ejection time and the input energy, shown in FIG. 10, described above.

If the pulse width ratio (P/Pth) is set to the same value for the first, second, and third nozzle arrays, the second nozzle array requires the longest preliminary ejection time. That is, for an apparatus using a print head including such three types of nozzle arrays, the time required for preliminary ejection of the apparatus corresponds to the longer preliminary ejection time for the nozzle array with the longer distance from the end of the ink supply port to the ejection openings. In this connection, the value of the pulse width ratio (P/Pth) is set to vary among the nozzle arrays. In this case, as is apparent from FIG. 10, the time required for preliminary ejection of the apparatus can be reduced by setting the value of the pulse width ratio (P2/Pth2) to be larger than those of the pulse width ratios (P1/Pth1) and (P3/Pth3).

Furthermore, as shown in FIG. 10, for the nozzle array with the shorter distance from the end of the ink supply port to the ejection openings, setting the pulse width ratio (P/Pth) to a greater value than necessary may increase the input energy. This indicates that the number of ejections required for the recovery operation cannot be effectively reduced even by setting the pulse width ratio (P/Pth) to a greater value than necessary, as described above with reference to FIGS. 6 and 7. That is, preferably, the driving pulse is set on the basis of the relationship between the pulse width ratio (P/Pth) and the number of ejections required for the recovery operation, with a reduction in energy consumed by the apparatus taken into account.

As described above, for the nozzle arrays through which relatively small ink droplets, in the present embodiment, ink droplets each with a size amounting to 3 pl, are ejected, the larger pulse width ratio (P/Pth) value is set for the nozzle array with the longer distance from the ink supply port to the ejection openings. This enables improvement of the throughput and energy saving.

Figure 11:
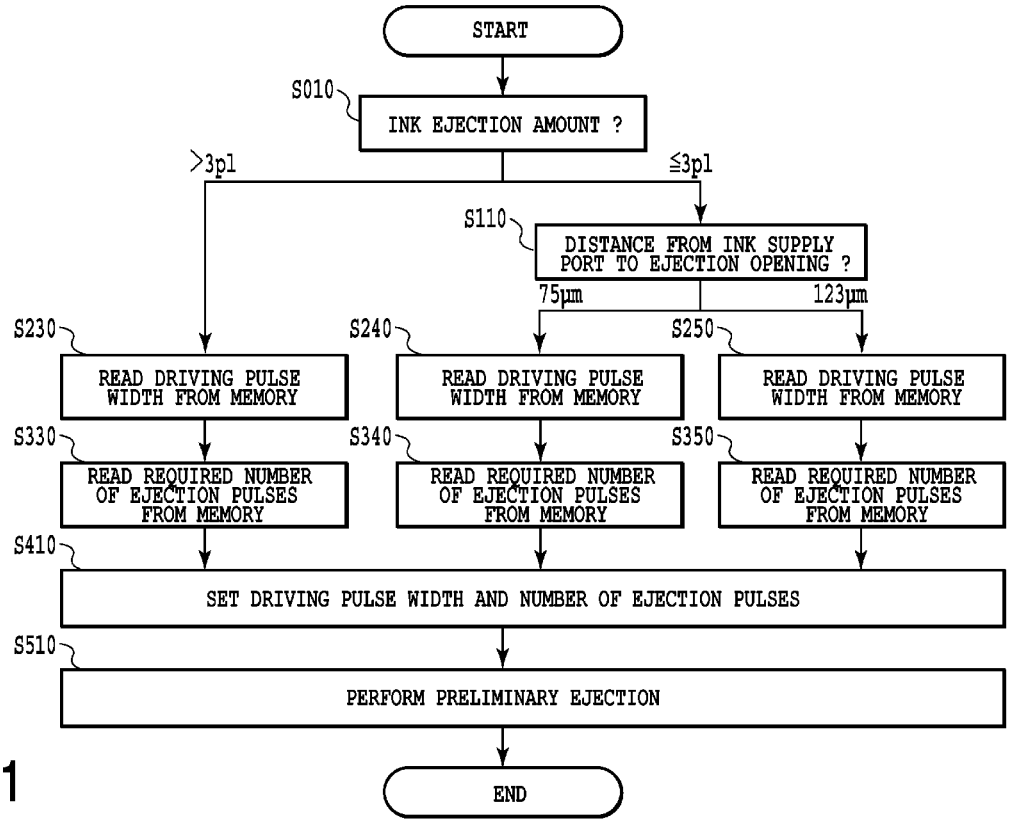
FIG. 11 is a flowchart showing preliminary ejection control according to the second embodiment of the present invention.

FIG. 11 is a flowchart showing preliminary ejection control using the different parameters (P/Pth) for the respective nozzle arrays with the different ink path lengths, which parameters are set as described above.

When the control is started, in step S010, the apparatus determines the ejection amounts of the print head to be subjected to the preliminary ejection. More specifically, in the present embodiment, the ejection amounts are determined to be 5 pl, 2 pl, and 1 pl. The determined ejection amounts are further classified into two types, the ejection amount of more than 3 pl and the ejection amount of equal to or smaller than 3 pl. For the nozzle array determined to have the ejection amount of more than 3 pl, specifically, the first nozzle array, the driving pulse width for the preliminary ejection is read from the memory in step S230. Subsequently, in step S330, the number of ejection pulses required for the preliminary ejection is read from the memory. On the other hand, for the nozzle arrays determined to have the ejection amount of equal to or smaller than 3 pl, that is, the second and third nozzle arrays, determination is made of the distance from the ink supply port to the ejection openings in each of the nozzle arrays forming the print head to be subjected to the preliminary ejection in step S110. In the present embodiment, the distances are determined to be 75 μm and 123 μm. Then, in steps S240 and S250, the preliminary pulse width for the preliminary ejection is read for each of the determined distances. In this case, the lower limit pulse width Pth2 and the driving pulse width P2 for the second nozzle array and the lower limit pulse width Pth3 and the driving pulse width P3 for the third nozzle array meet the condition "pulse width ratio (P2/Pth2)>pulse width ratio (P3/Pth3)". Moreover, in steps S340 and 350, the number of ejection pulses required for the preliminary ejection is read from the memory for each of the determined distances. Subsequently, in step S410, the read driving pulse widths and the number of ejection pulses are set in the memory. Then, in step S510, the preliminary ejection is performed on the basis of the conditions set in step S410. The preliminary ejection routine is thus completed.

Other Embodiments

In the above-described embodiments, the pulse width is a parameter for the ejection energy supplied to the electro-thermal conversion elements. However, of course, the present invention is not limited to this aspect. For example, the parameter may be the voltage value or waveform of the applied pulse. In short, lower limit energies Eth1 and Eth2 applied to the electro-thermal conversion elements (heaters) and required for ejection and energies E1 and E2 required for the actual preliminary ejection have only to meet the condition (E2/Eth2)>(E1/Eth1).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-300827, filed Nov. 20, 2007, which is hereby incorporated by reference herein in its entirety.

What is claimed is:

1. An ink jet printing apparatus that performs printing by using a print head provided with ejection openings for ejecting inks and heaters to which pulses are applied for generating thermal energy to eject ink, said apparatus comprising:

a print head control unit that drives the print head by applying pulses to the heaters to generate thermal energy to eject ink; and a processing unit that controls said print head control unit to eject the ink from the print head in a recovery operation for the print head other than a printing operation, the recovery operation being a preliminary ejection, wherein the print head includes a first ejection opening and a second ejection opening, and a distance from an ink supply port, common to the first and second ejection openings, to the second ejection opening is greater than a distance from the ink supply port to the first ejection opening, and said processing unit controls said print head control unit to apply the pulses which meet a condition that a ratio (E2/Eth2) is greater than a ratio (E1/Eth1) in which Eth1 and Eth2 are lower limit energies supplied to the heaters and required for ink ejection through the first and the second ejection openings, respectively, and E1 and E2 are energies supplied to the heaters for ink ejection through the first and the second ejection openings, respectively, and to apply a respective predetermined number of the pulses to the heaters for ink ejection through the first and second ejection openings, in the preliminary ejection controlled by said processing unit.

2. The ink jet printing apparatus as claimed in claim 1, wherein in the ink ejection by said processing unit, respective numbers of ink droplets ejected from the first and the second ejection openings are determined based on the ratios (E2/Eth2) and (E1/Eth1).

3. The ink jet printing apparatus as claimed in claim 1, wherein the ratios (E2/Eth2) and (E1/Eth1) are expressed as ratios (P2/Pth2) and (P1/Pth1), respectively, in which Pth1 and Pth2 are lower limit pulse widths required for ink ejection through the first and the second ejection openings, respectively, and P1 and P2 are driving pulse widths for ink ejection by said processing unit through the first and the second ejection openings, respectively.

4. The ink jet printing apparatus as claimed in claim 1, wherein ink ejection amounts ejected from the first and second ejection openings are amounts equal to or smaller than 3 pl, respectively.

5. An ink ejection control method of an ink jet printing apparatus that performs printing by using a print head provided with ejection openings for ejecting inks and heaters to which pulses are applied for generating thermal energy to eject ink, said method comprising the steps of:

a preliminary ejection step that ejects the ink from the print head in a recovery operation for the print head other than a printing operation, wherein said preliminary ejection step applies the pulse having energy to the to the heater to generate thermal energy that ejects ink, the print head includes a first ejection opening and a second ejection opening, and a distance from an ink supply port, common to the first and second ejection openings, to the second ejection opening is greater than a distance from the ink supply port to the first ejection opening, and said preliminary ejection step applies the pulses which meet a condition that a ratio (E2/Eth2) is greater than a ratio (E1/Eth1) in which Eth1 and Eth2 are lower limit energies supplied to the heaters and required for ink ejection through the first and the second ejection openings, respectively, and E1 and E2 are energies supplied to the heaters for ink ejection through the first and the second ejection openings, respectively, and to apply a respective predetermined number of the pulses to the heaters for ink ejection through the first and second ejection openings, in the ink ejection in said preliminary ejection step.

6. An ink jet printing apparatus that performs printing by using a print head for ejecting inks, said apparatus comprising:

a print head including:

an ink supply port;

a first ejection opening to which ink is supplied from said ink supply port for ejecting ink;

a first heater that is driven for ejecting ink from said first ejection opening, a lower limit pulse width applied to said first heater for ejecting ink from said first ejection opening being Pth1;

a second ejection opening to which ink is supplied from said ink supply port for ejecting ink, a distance between said second ejection opening and said ink supply port is greater than a distance between said first ejection opening and said ink supply port;

a second heater that is driven for ejecting ink from said second ejection opening, a lower limit pulse width applied to said second heater for ejecting ink from said second ejection opening being Pth2; and a driving unit for driving said first heater and said second heater, said driving unit applying pulses to said first heater and said second heater so that a pulse width P1 of the pulse to be applied to said first heater and a pulse width P2 of the pulse to be applied to said second heater meet conditions of (P1/Pth1)<(P2/Pth2) when preliminary ejections are performed for said first ejection opening and said second ejection opening.

* * * * *